US010206856B1

(12) United States Patent
Scoville

(10) Patent No.: US 10,206,856 B1
(45) Date of Patent: Feb. 19, 2019

(54) APPARATUS FOR FLUID ADMINISTRATION TO AN INDIVIDUAL

(71) Applicant: Agnes Scoville, Kirkwood, MO (US)

(72) Inventor: Agnes Scoville, Kirkwood, MO (US)

(73) Assignee: Agnes Scoville, Saint Louis, MO (US)

( * ) Notice: Subject to any disclaimer, the term of this patent is extended or adjusted under 35 U.S.C. 154(b) by 63 days.

(21) Appl. No.: 14/455,929

(22) Filed: Aug. 10, 2014

(51) Int. Cl.
*A61J 11/00* (2006.01)
*A61J 7/00* (2006.01)
*A61J 17/00* (2006.01)

(52) U.S. Cl.
CPC ..... *A61J 11/0005* (2013.01); *A61J 7/0053* (2013.01); *A61J 2017/006* (2013.01)

(58) Field of Classification Search
CPC ..... A61J 17/00; A61J 17/006; A61J 1/1418; A61J 7/0053; A61J 2015/008; A61J 2017/006; A61J 7/0046; A61J 11/00; A61J 11/04; A61J 17/001; A61J 11/0005; A61J 2200/76; A61J 7/0061; A61J 9/00; A61J 11/0015; A61J 11/007; A61J 11/0095; A61J 11/045; A61J 9/005; A61M 16/0488; A61M 16/049; A61M 2205/59; A61M 15/002
USPC ..... 606/234; 604/76, 77
See application file for complete search history.

(56) References Cited

U.S. PATENT DOCUMENTS

| | | | | |
|---|---|---|---|---|
| 5,013,321 | A * | 5/1991 | MacVane | 606/234 |
| 5,318,523 | A * | 6/1994 | Lu | 604/77 |
| 5,843,030 | A * | 12/1998 | Van Der Merwe | A61J 7/0046 604/77 |
| 5,891,165 | A * | 4/1999 | Buckner | 606/234 |
| 6,126,679 | A * | 10/2000 | Botts | A61J 7/0046 215/11.1 |
| 6,139,566 | A * | 10/2000 | Bennett | A61J 7/0046 606/234 |
| 2009/0248074 | A1* | 10/2009 | Kliegman et al. | 606/236 |
| 2010/0030264 | A1* | 2/2010 | Roehrig et al. | 606/234 |

FOREIGN PATENT DOCUMENTS

| | | | |
|---|---|---|---|
| CA | 2548976 | * 12/2007 | A61J 17/00 |

* cited by examiner

*Primary Examiner* — Brandy S Lee

(57) ABSTRACT

A pacifier system is configured for administering fluid to an infant. The system includes a pacifier having a supple nipple, a mouth guard, and a syringe coupler configured to removably attach to a syringe. A passageway extends through the pacifier and attaches to a standard oral syringe for expelling fluid from the syringe into the passageway of pacifier and into a mouth of an infant.

17 Claims, 5 Drawing Sheets

APPARATUS FOR FLUID ADMINISTRATION TO AN INDIVIDUAL

REFERENCE TO PRIORITY DOCUMENT

This patent application claims the benefit of priority to U.S. Provisional Patent Application Ser. No. 61/864,613 entitled "Apparatus for Medication Administration to Infants Using Pacifier and Standard Oral Syringe", filed on Aug. 11, 2014. Priority to the aforementioned filing date is claimed and the provisional patent application is incorporated by reference in its entirety

BACKGROUND

The present disclosure relate to devices for administering fluid, such as a fluid medication, to an individual. The device can be used to administer fluid to any individual, including an infant or elderly individual for example.

Much evidence indicates that caregivers make errors in administering medication to children. Inaccurate dosing of medication to an infant is a common problem as care providers often measure a medication dose incorrectly or provide the medication outside the prescribed range of dosage. This can have significant implications for drug resistance and treatment failure and can be particularly problematic in underweight and premature infants.

The use of an oral syringe to deliver fluid medication is generally considered a safe and accurate method for administering medication. It is the standard method if delivering oral medication in a hospital setting. A pacifier is generally better received by an infant than a standard hard oral syringe. Given that many pediatric caregivers inaccurately dose medication, there is a need for a pacifier or nipple device with precise measurement capabilities and that can be used with equipment that is familiar to doctors, pharmacists and lay caregivers.

SUMMARY

Disclosed are various embodiments of a pacifier device that overcome disadvantages of the prior infant pacifier devices that administer fluids to the infant. The disclosed pacifier devices are configured for administering medication and liquids by using syringes to measure and plunge the medication, thereby improving accuracy in dosing. The disclosed devices employ an oral type syringe attachment such that the pacifier is connected safely to the supple nipple component of the pacifier and cannot become disengaged. An inner, medication-carrying passageway within the pacifier supple nipple is minimized in order to prevent dead space within the tube, while having sufficient volume to allow flow of viscous medication, gel-type medication, or thixotropic medication. The pacifier device delivers medication to the mid-tongue, an area deficient in sweet and bitter taste buds. The device also limits the use of plastic, limiting the environmental impact.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing a particular embodiment or embodiments only, and is not intended to be limiting. Unless defined otherwise, all technical terms used herein have the same meaning as commonly understood by one skilled in the art to which this subject matter belongs.

Disclosed is a pacifier device that can be used to safely and easily administer a fluid, such as a medication, to a human. The device can be used to administer fluid to any human. In an example described herein, the device is used to administer fluid to an infant. In another example, the device is used to administer fluid to an elderly person. Any fluid can be administered, including a medication fluid. In another embodiment, the pacifier device is used to treat dehydration pursuant to oral rehydration therapy by delivering a fluid such as Pedialyte. The device is adapted to attach to a standard oral syringe for accurate dosing of a fluid to an infant and to stay securely mounted to the syringe during use. The device is adapted to minimize or eliminate the introduction of contaminants into the fluid during administration of the fluid to the infant. The disclosed device improves upon prior devices and techniques by limiting wasted medication in the device to improve dosing accuracy.

Figure 1:
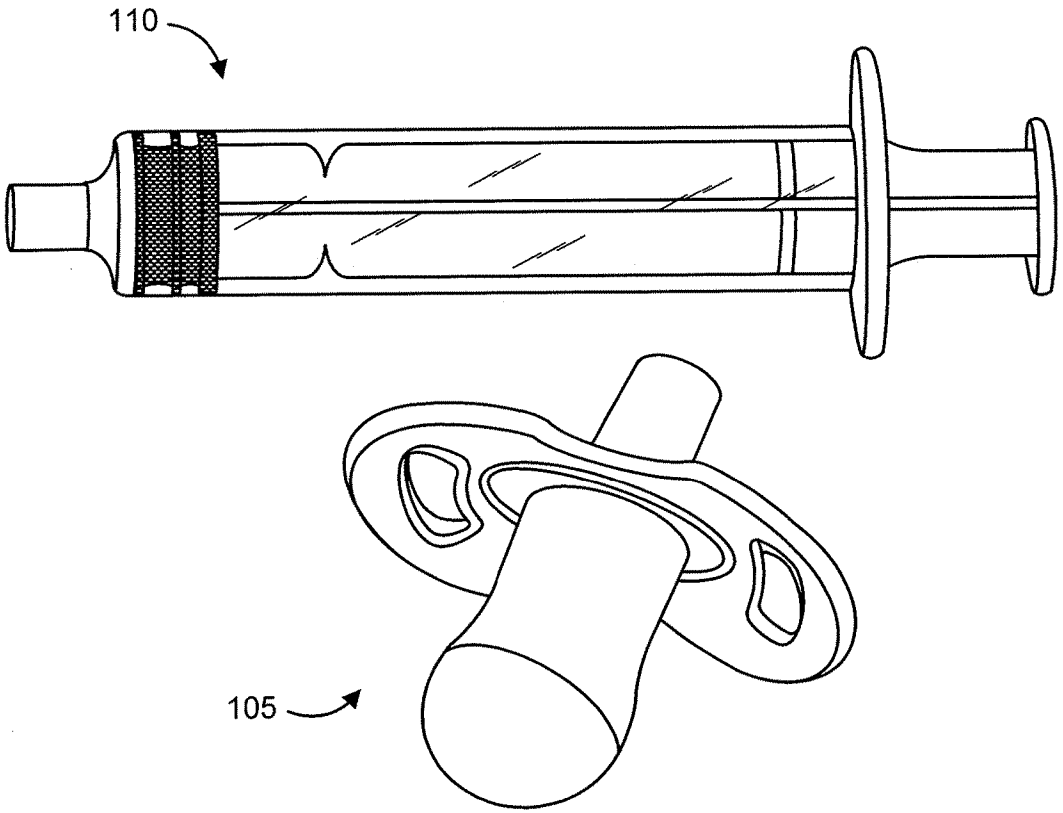
FIG. 1 shows a perspective view of a pacifier system for administering a fluid, such as a fluid medication, to an infant or child.

FIG. 1 shows a perspective view of a system for administering a fluid medication to an infant or child. The system includes a pacifier device 105 having a portion sized and shaped to be positioned in an infant's mouth for administering fluid medication to the infant. The system further includes a syringe 110 that fluidly couples to the pacifier device 105 injecting or otherwise delivering fluid medication from the syringe to the infant via the pacifier device 105, as described in more detail below. The syringe 110 can be a standard oral syringe that attaches to the pacifier device without any modification needed to the pacifier device or the syringe.

Figure 2:
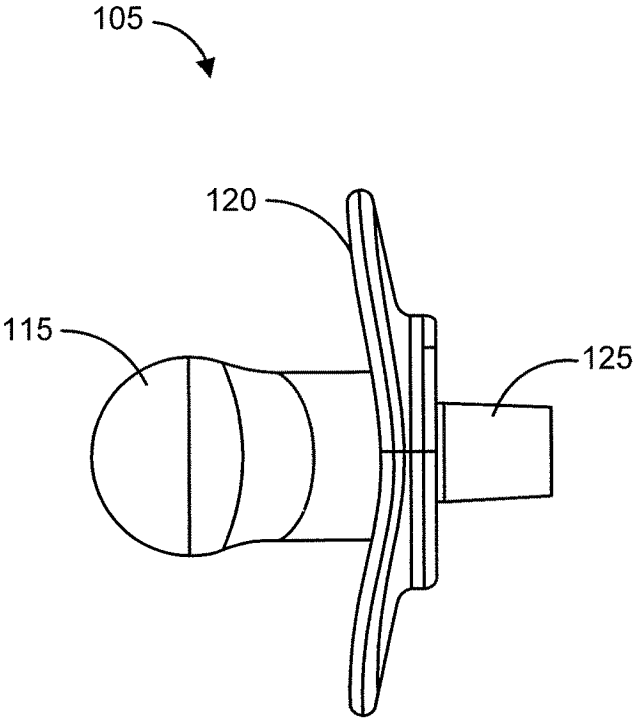
FIG. 2 shows a side view of a pacifier device.

FIG. 2 shows a side view of the pacifier device 105. The pacifier device includes a nipple 115 sized and shaped to ergonomically and comfortably fit within the mouth of an infant. In this regard, the nipple 115 is bulb shaped with a rounded, widened tip that extends from a more narrow body portion. It should be appreciated that the nipple 115 can vary in size and shape. The nipple 115 is positioned adjacent a plate-like mouth guard 120 that is sized and shaped to rest adjacent the infant's mouth and lips when the nipple 115 is in the infant's mouth. A mouth-facing side of the mouth guard 120 is ergonomically shaped to comfortably fit against the region of the infant's face around the mouth. The mouth guard 120 may be made of a material that is harder or more rigid than the soft and supple material of the nipple 115.

With reference still to FIG. 2, a syringe coupler 125 is located on the pacifier device 105 on a side of the mouth guard 120 opposite the nipple 115. The syringe coupler 125 is sized and shaped to be removably coupled to or attached to the syringe such that fluid can flow from the syringe into a passageway of the pacifier device, as described in more detail below. The size and shape of the syringe coupler can vary. The syringe coupler may define a cavity that snugly receives a portion of the syringe in a male-female relationship.

In an embodiment, the syringe coupler is sized and shaped to attach to a standard slip tip of the syringe by sliding onto or into the slip tip of the syringe. A slip tip is a generally cylindrical shaped structure that serves as a male or female connector and that couples to a corresponding female or male connector on a complementary device. In another embodiment, the syringe coupler 125 is a Luer lock coupler that locks onto a corresponding Luer lock of the syringe.

Figure 3:
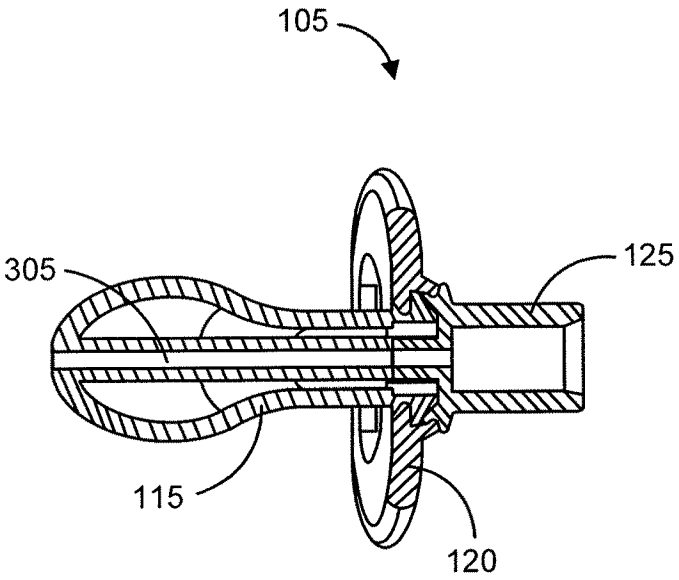
FIG. 3 shows a cross-sectional view of the pacifier device.

FIG. 3 shows a cross-sectional view of the pacifier device 105. A passageway 305 extends through the pacifier device 105 from an opening in a first end of the pacifier device 105 to an opening in a second end of the pacifier device. The passageway 305 provides a lumen for fluid medication to flow from the syringe 110 to the infant's mouth when the pacifier device 105 is in the infant's mouth and the syringe 110 is attached to the syringe coupler 125 of the pacifier device, as described more fully below.

The passageway is formed by a tube, such as for example a, straight and/or cylindrical tube, that is positioned inside the nipple 115. A first end (with opening) of the tube is at the tip of the nipple and a second end (with opening) is at or near the mouth guard 120. The tube may be more rigid than the nipple such as by making the tube of a more rigid material. The tube provides a rigid and structurally secure means of forming the passageway 305. The central tube provides a defined structure for the passageway and prevents medicine from pooling in the nipple. The tube can be integrally formed with the nipple (such that the tube and nipple are monolithic) or it can be a separate structure from the nipple and connected to the nipple.

The passageway has a narrowed region that extends through the nipple 115 and the mouth guard 120. The passageway 305 opens at one end into the syringe coupler 125 such that the syringe will fluidly communicate with the passageway 305 when attached to the pacifier device 105. The narrow region of the passageway is sized to regulate fluid flow through the passageway as it approaches the infant's mouth from the syringe 110. The diameter of the passageway is substantially smaller than the narrowest portion of the nipple 115, yet sufficiently large to allow the flow of relatively viscous medication, of gel-type medication, or of thixotropic medication. The substantially smaller diameter provides very low dead space in the nipple resulting in almost all of the medication in the syringe being expelled from the passageway during the plunging process thereby resulting in accurate dosing.

In an example embodiment, the diameter of the passageway is about 2 millimeters and the diameter of the narrowest portion of the nipple 115 is about 10 millimeters.

As mentioned, the passageway 305 forms an opening or entryway in the first end of the pacifier device 105 at the location of the syringe coupler 125. The passageway 305 forms a second opening or exit way in the second end of the pacifier device at the tip of the nipple 115. Fluid medication flows into the passageway 305 from the syringe 110 via the entryway and flows out of the passageway into the infant's mouth via the exit way during use.

Figure 4:
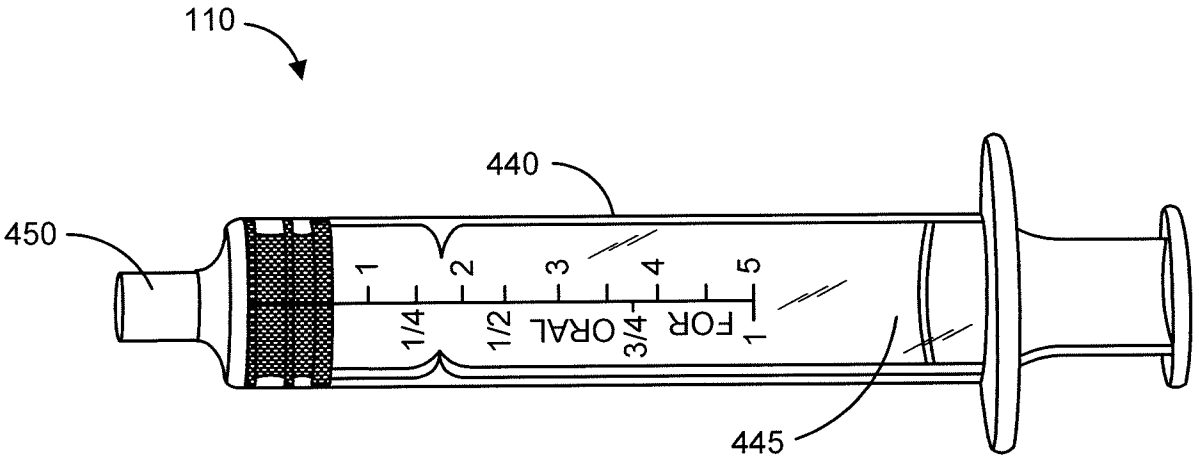
FIG. 4 shows a side view of a syringe.

With reference now to FIG. 4, the syringe 110 is a standard pump type syringe having a tubular body 440 containing a plunger 445 slidably mounted therein. One end of the plunger can be pressed by a user to push the plunger so as to cause the plunger to slide through the body. A seal at the opposite end of the plunger pushes fluid out of the tubular body as the plunger slides through tubular body. The tubular body or barrel defines an internal volume sized to contain a predetermined amount of fluid. A coupler element 450 is sized and shaped to fluidly couple to the syringe coupler 125 of the pacifier device 105. The coupler element 150 has an orifice through which fluid medication can be expelled out of the body 140.

The body 140 of the syringe 110 may have one or more markers, such as a graduated scale, that serve to identify a measurement of a volume of fluid in the barrel of the syringe 110. The graduated scale may be in various units, including milliliters and teaspoons, for example.

Figure 5:
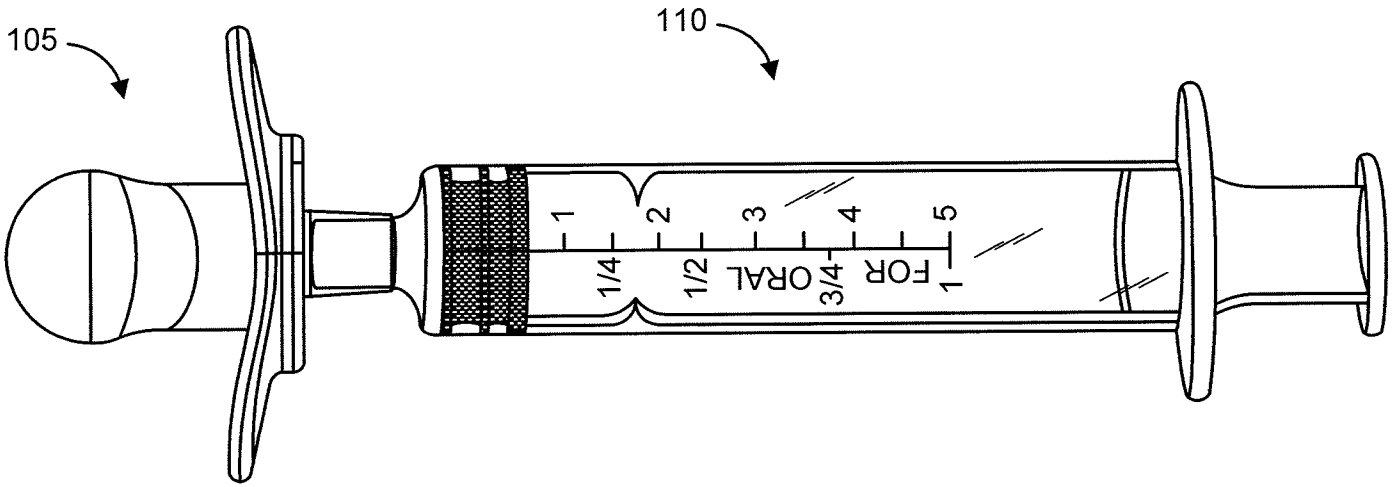
FIG. 5 shows the syringe attached to the pacifier device.

When the coupler element 450 is coupled to the syringe coupler of the pacifier device, fluid can be expelled out of the body 440 and into the passageway of the pacifier device by pressing the plunger 445 into the body 440. In this regard, the plunger has a thumb or finger element. As mentioned, the coupler element 450 can be a slip tip of the syringe that slips on or into a complementary slip tip of the pacifier device. FIG. 5 shows the syringe 110 attached to the pacifier device 105. The coupler element of the syringe 110 is inserted into the syringe coupler of the pacifier device. This places the internal volume of the syringe 110 in fluid communication with the passageway of the pacifier device 105 such that fluid can be expelled from the syringe into the passageway toward an infant's mouth.

The nipple may be made of any of a variety of soft, non-toxic materials including but not limited to silicone. The mouth guard and the coupler elements may be made of any of a variety of materials, including nontoxic, hard plastic suitable material such as for example: ABS (Acrylonitrile Butadiene Styrene), SAN (Styrene Acrylonitrile), and plant-based, biodegradable plastics such as PLA (Polylactic Acid.)

The system is used as follows. The nipple of the pacifier device is positioned in the infant's mouth. The nipple may be positioned such that fluid medication is delivered to the mid-tongue of the infant, which is an area devoid of sweet and bitter taste buds, which minimizes expectoration and the rejection of medications. The syringe is then filled with the appropriate dosage volume of fluid medication. Alternately, the syringe may be filled prior to insertion of the pacifier device into the infant's mouth. The syringe is then attached to the pacifier device by coupling the coupler element of the syringe to the syringe coupler of the pacifier device, as shown in FIG. 5. As mentioned, the couplers may be slip tip type couplers that insert into one another in a male-female relationship.

With the nipple of the pacifier device in the infant's mouth and the syringe fluidly attached to the pacifier device, the user may then depress the plunger to expel the fluid medication out of the syringe into the infant's mouth via the passageway in the pacifier device.

Figure 6:
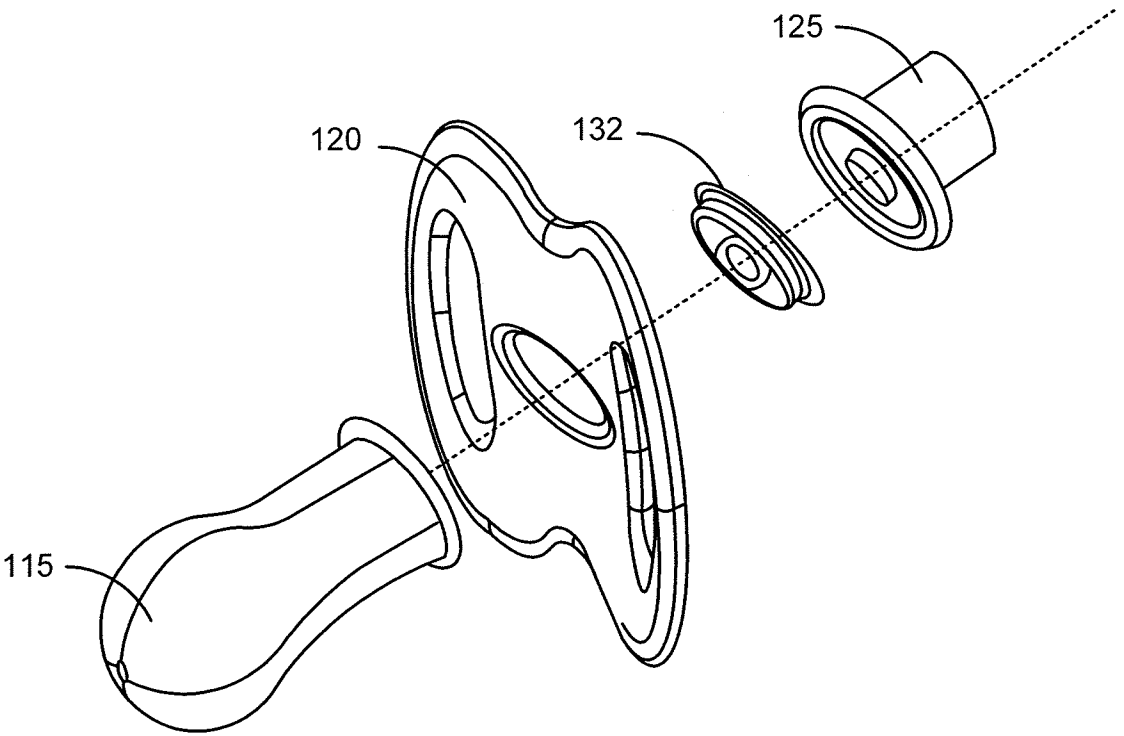
FIG. 6 shows the pacifier device in a disassembled, exploded state.

FIG. 6 shows the pacifier device in a disassembled and exploded state. The pacifier device is formed of several components including the nipple 115, the mouth guard 120, the syringe coupler 125, and a connector 132 that connects and secures the components to one another. The components align along a common axis and connect along that axis. The axis can co-axially align with the passageway and/or tube inside the nipple. The pacifier device is assembled by inserting an end of the nipple 115 through a central opening in the mouth guard 120. The end of the nipple 115 may have a lip or other structure that assists in aligning and securing the nipple 115 with the opening of the mouth guard 120. The connector 132 also inserts into the opening of the mouth guard 120 opposite the nipple. The connector 132 and the nipple 120 each has a connector region with shapes that complement and fit into the opening in the mouth guard 120. The connector 132 secures to the nipple and the tube within the nipple to maintain the tube in a fixed alignment with mouth guard. This prevents the tube from moving or becoming misaligned. Finally, the syringe coupler 125 inserts into or over the connector 132 and secures thereto. The collection of components may be secured to one another in various manners including with the use of adhesive.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

The invention claimed is:

1. A pacifier system for administering fluid to an infant, comprising:

a pacifier having a supple nipple, a mouth guard, a connector, and a syringe coupler configured to removably attach to a syringe, wherein only a single and sole passageway extends through the nipple for fluid to pass into a user's mouth via the nipple, the passageway having an entryway in the region of the syringe coupler and an exit way in a tip of the nipple;

a standard oral syringe having a tubular body defining an internal volume for containing a liquid medicant, the syringe further having plunger that slides through the internal volume to expel fluid medicant out of an orifice in the tubular body, the syringe further having a coupler element that removably attaches to the syringe coupler of the pacifier to place the internal volume of the syringe in fluid communication with the passageway of the pacifier device;

a single tube that defines the entire, single passageway and that extends through the nipple, the tube having a first end with a first opening that forms at least a portion of the entryway of the passageway in the region of the syringe coupler and a second end with a second opening that forms the exit way of the passageway in the tip of the nipple, wherein the first end of the tube terminates at the mouth guard, wherein the single tube is supported structurally by the pacifier only at the first end and at the second end of the single tube;

the connector, which connects and secures the tube to the nipple, the mouth guard and the syringe coupler such that components of the system align along a common axis and connect along the common axis, wherein the axis co-axially aligns with a straight axis of the tube;

wherein the plunger can be actuated to expel fluid from the internal volume of the syringe into the passageway of the pacifier and into a mouth of an infant when the syringe is attached to the pacifier and the nipple is in the mouth of the infant, wherein the syringe coupler is positioned in direct contact with the mouth guard.

2. A system as in claim 1, wherein the passageway of the pacifier has a diameter of about 2 millimeters.

3. A system as in claim 1, wherein the syringe coupler of the pacifier attaches to the coupler element of the syringe in a male-female relationship.

4. A system as in claim 1, wherein the syringe coupler of the pacifier is a slip tip.

5. A system as in claim 1, wherein the nipple is sized such that the fluid is delivered to the mid-tongue of the infant when the nipple is in the infant's mouth.

6. A system as in claim 1, wherein the nipple is made of a soft, non-toxic material.

7. A system as in claim 1, wherein the nipple is made of silicone.

8. A system as in claim 1, wherein the mouth guard is made of a hard plastic material.

9. A system as in claim 1, wherein the mouth guard is made of ABS (Acrylonitrile Butadiene Styrene), SAN (Styrene Acrylonitrile), or plant-based, biodegradable plastic including PLA (Polylactic Acid).

10. A system as in claim 1, wherein the syringe contains a fluid gel.

11. A system as in claim 1, wherein the tube is more rigid than the nipple.

12. A system as in claim 1, wherein the tube is made of a material that is different than a material of the nipple.

13. A system as in claim 1, wherein the tube is made of a material that is more rigid than a material of the nipple.

14. A system as in claim 1, wherein the syringe coupler has a tubular portion that extends into the mouth guard.

15. A system as in claim 14, wherein the syringe coupler is a monolithic body having a flange in contact with the mouth guard and a cylinder that attaches to the syringe.

16. A system as in claim 1, wherein the mouth guard has a central opening and an end of the nipple has a lip that aligns and secures the nipple with the opening of the mouth guard, and wherein the connector also inserts into the opening of the mouth guard opposite the nipple, and wherein the connector and the nipple each has a connector region with shapes that complement and fit into the opening in the mouth guard such that the connector secures to the nipple and the tube within the nipple to maintain the tube in a fixed alignment with mouth guard.

17. A system as in claim 16, wherein the syringe coupler inserts into or over the connector and secures thereto.

* * * * *